US011815089B2

(12) United States Patent
Bignon et al.

(10) Patent No.: US 11,815,089 B2
(45) Date of Patent: Nov. 14, 2023

(54) PUMPING SYSTEM AND FLUID DELIVERY INSTALLATION

(71) Applicants: Pierre Bignon, Saint Paul (FR); Armand Wan-Hoi, Saint Paul (FR); Anton Bouwer, Trois Bassins (FR)

(72) Inventors: Pierre Bignon, Saint Paul (FR); Armand Wan-Hoi, Saint Paul (FR); Anton Bouwer, Trois Bassins (FR)

(73) Assignee: Armand Wan Hoi, Saint-Paul (FR)

( * ) Notice: Subject to any disclaimer, the term of this patent is extended or adjusted under 35 U.S.C. 154(b) by 6 days.

(21) Appl. No.: 17/424,865

(22) PCT Filed: Jan. 24, 2019

(86) PCT No.: PCT/FR2019/050159
§ 371 (c)(1),
(2) Date: Jul. 21, 2021

(87) PCT Pub. No.: WO2020/152402
PCT Pub. Date: Jul. 30, 2020

(65) Prior Publication Data
US 2022/0120260 A1 Apr. 21, 2022

(51) Int. Cl.
*F04B 9/113* (2006.01)
*F04B 53/10* (2006.01)

(52) U.S. Cl.
CPC ..... *F04B 9/113* (2013.01); *F04B 53/1095* (2013.01)

(58) Field of Classification Search
CPC ..... F04B 9/113; F04B 9/133; F04B 53/10; F04B 53/1095
See application file for complete search history.

(56) References Cited

U.S. PATENT DOCUMENTS 3,070,023 A * 12/1962 Glasgow ..... F04B 9/111 91/305
3,312,172 A * 4/1967 Harklau ..... F01L 23/00 417/393
4,512,151 A * 4/1985 Yamatani ..... F15B 3/00 92/174
5,765,375 A * 6/1998 Lundback ..... F04B 9/1076 60/580

(Continued)

FOREIGN PATENT DOCUMENTS

DE 38208 2/1887
FR 2441075 6/1980

(Continued)

*Primary Examiner* — Thomas Fink
(74) *Attorney, Agent, or Firm* — DUANE MORRIS LLP; Gregory M. Lefkowitz

(57) ABSTRACT

The invention relates mainly to a pumping system (1) which comprises an alternating distribution device comprising at least one shut-off device (7) comprising four mobile shut-off members (70-73) for shutting off first and second inlets (E1, E2; E1*a*, E2*a*) and first and second outlets (S1, S2; S1*a*, S2*a*) of the pumping system (1) and at least one trigger (8, 9) configured to actuate said shut-off members (70-73) between two positions, respectively a shutting-off position and an open position, which alternating distribution device can be actuated between a first arrangement associated with a first fluid distribution cycle and a second arrangement associated with a second fluid distribution cycle.

11 Claims, 3 Drawing Sheets

(56) References Cited

U.S. PATENT DOCUMENTS

| | | | | |
|---|---|---|---|---|
| 7,955,058 | B1 * | 6/2011 | Angel | F04B 9/113 417/396 |
| 2010/0290937 | A1 * | 11/2010 | Trout | F04B 23/06 417/418 |
| 2022/0065237 | A1 * | 3/2022 | Cook | F04B 23/02 |

FOREIGN PATENT DOCUMENTS

| | | | |
|---|---|---|---|
| FR | 2441075 | A1 * | 6/1980 |
| FR | 3039596 | | 2/2017 |
| WO | 0159300 | | 8/2001 |

* cited by examiner

Fig. 4
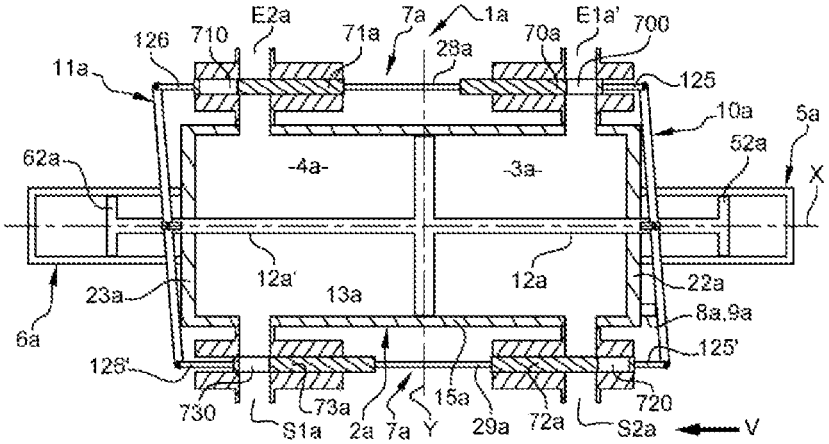
Fig. 5
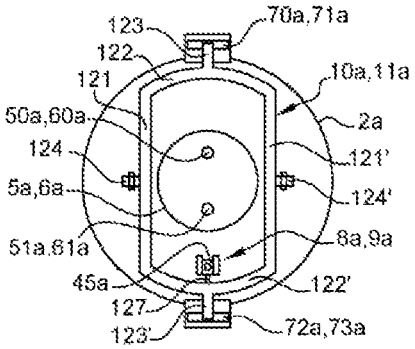
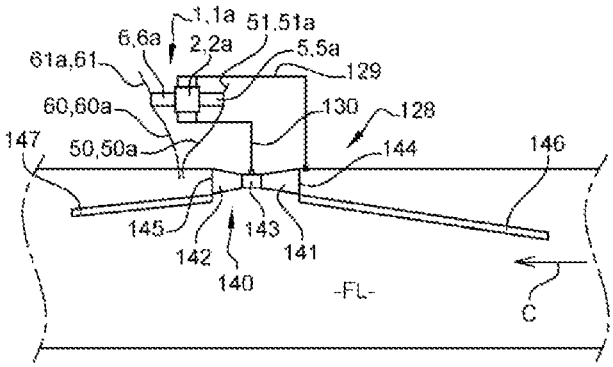
Fig. 6

PUMPING SYSTEM AND FLUID DELIVERY INSTALLATION

CROSS-REFERENCE TO RELATED APPLICATIONS

This application is a § 371 national stage entry of International Application No. PCT/FR2019/050159, filed Jan. 24, 2019, the entire contents of which are incorporated herein by reference.

TECHNICAL FIELD

The invention generally relates to a system for delivering a fluid.

More particularly, the invention relates to a pumping system for delivering a fluid, such as water, from a low altitude zone to a higher altitude zone.

PRIOR ART AND DRAWBACKS OF THE PRIOR ART

The supply water to mountainous areas or plateaus with no water resources constitutes a major problem for the inhabitants of these areas.

Thus, in order to supply water to areas at altitudes of several hundred meters, delivery pumps driven by combustion engines or electric engines are known to be used. These delivery pumps make it possible to deliver water located at a first area at a low altitude to a second area at a higher altitude. However, although such delivery pumps are energy efficient, installing and using them incur significant costs.

As an alternative to motorized pumps, hydraulic rams are known to be used since installing them is less expensive and require little maintenance.

The principle of a hydraulic ram is based on the use of a phenomenon called "water hammer" which is an overpressure created when a fluid flowing in a column at a certain speed is abruptly interrupted by a valve. The overpressure makes it possible to raise a certain quantity of fluid much higher than the height of the initial column.

However, the use of a hydraulic ram is not always satisfactory and has some drawbacks such as the noise generated by the "water hammer", the need to make complex adjustments during installation, or otherwise a weak and choppy flow rate as well as a limited delivery height with respect to the motorized pumps.

To overcome these drawbacks, research has been undertaken in order to develop different solutions making it possible to obtain both good energy efficiency while limiting installation and maintenance costs.

Among these solutions, a hydromechanical pump has been proposed, described in particular in patent application FR 3039596 A1.

As illustrated in FIG. 1, such a hydromechanical pump 1000 comprises an engine chamber 280 inside which a drive piston 220 slides. The drive piston 220 is rigidly connected to a central shaft 340 which extends into a first multiplier chamber 300 and in a second multiplier chamber 320 arranged on either side of the engine chamber 280. The first multiplier chamber 300 and the second multiplier chamber 320 have an inlet 400, 360 and an outlet 420, 380 for, respectively, receiving a fluid and discharging a fluid under pressure.

In addition, the pump 1000 includes a device for alternating the direction of distributing a pressurized fluid across the drive piston 220. The device for alternating the direction of delivery of the fluid includes a distribution carriage 340, 460, 480, 500 sliding within a distribution chamber 200 so as to seal and/or disengage an array of intake and delivery ducts 520, 540, 560, 680, 600, 620 communicating with the engine chamber 280 as well as with the inlets 400, 360 of the multiplier chambers 300, 320.

The introduction of the pressurized fluid into the engine chamber 280 by the network of intake and delivery ducts 520, 540, 560, 680, 600, 620 causes the drive piston 220 to slide in the engine chamber 1080, 280 and thus the central shaft 340 in the multiplier chambers 300, 360. The sliding of the central shaft 340 in the multiplier chambers 300, 360 ensures the compression of the fluid present inside one of the multiplier chambers 300, 360, which causes the fluid under pressure to be discharged through the outlet 360, 380 of the said multiplier chamber 300, 360.

The distribution carriage 340, 460, 480, 500 of the distribution chamber 200 is moved by actuators which are controlled by mechanical, or hydraulic, devices, by feedback according to the position of the drive piston 220 in the engine chamber 280. The movement of the distribution carriage 340, 460, 480, 500 in the distribution chamber 200 provides the reversal of the direction of circulation of the pressurized fluid in the engine chamber 280.

This principle allows the pump 1000 to operate autonomously with very little energy and to ensure sufficient pressurization of the fluid for delivery in a high altitude area.

However, such a pump 1000 has drawbacks, in particular with regard to its operating conditions.

Indeed, it is difficult to ensure perfect sealing of the intake and delivery ducts 520, 540, 560, 680, 600, 620 by the distribution carriage, in particular when the fluid pressure becomes large. In fact, the delivery pressure of the fluid remains limited.

OBJECTIVE OF THE INVENTION

The aim of the invention is to provide a pumping system with increased reliability at high fluid pressures, and thus generate a sufficiently high fluid delivery pressure in order to enable, in particular, uses for handling the delivered fluid.

DISCLOSURE OF THE INVENTION

To this end, the invention relates to a pumping system for the delivery of a pressurized fluid, comprising:

- a drive enclosure within which is positioned a drive piston configured to slide therein along a longitudinal axis of said drive enclosure between first and second end positions under the action of a pressurized operating fluid, the drive piston separating said drive enclosure into a first drive chamber and a second motive chamber,
- a first multiplier chamber and a second multiplier chamber having an inlet and an outlet for, respectively, receiving and discharging a delivery fluid,
- a first multiplier piston, connected to the drive piston and configured to slide within the first multiplier chamber, the sliding of the first multiplier piston ensuring the compression of the delivery fluid inside the first multiplier chamber such that the pressure of the delivery fluid at the outlet is greater than the pressure of the delivery fluid at the inlet of the first multiplier chamber,
- a second multiplier piston, connected to the drive piston and configured to slide within the second multiplier chamber, the sliding of the second multiplier piston ensuring the compression of the delivery fluid inside the second multiplier chamber such that the pressure of the delivery fluid at the outlet is greater than the pressure at the inlet of the second multiplier chamber, an alternating fluid distribution device for alternating the direction of circulation of the operating fluid in the drive enclosure, the pumping system being characterized in that it comprises a first fluid inlet opening into the first drive chamber and a first fluid outlet from the second drive chamber for, respectively, receiving and discharging the operating fluid during a first distribution cycle, in that it comprises a second fluid inlet opening into the second drive chamber and a second fluid outlet from the first drive chamber, for, respectively, receiving and discharging the operating fluid during a second distribution cycle, and in that the alternating distribution device comprises at least one shut-off device comprising four movable shut-off members of the first and second inlets and the first and second outlets of the pumping system and at least one trigger configured to actuate said shut-off members between two positions, respectively a shutting-off position and an open position, which alternating distribution device can be actuated between:

a first arrangement associated with the first distribution cycle in which the drive piston moves to its second end position, two of the movable members respectively shut off the second inlet and the second fluid outlet, and the other two movable members respectively open the first inlet and the first fluid outlet to ensure the introduction and discharge of the operating fluid, a second arrangement associated with a second fluid distribution cycle in which the drive piston moves towards its first end position, two of the movable members respectively shut off the first inlet and the first outlet, and the other two movable members open, respectively, the second inlet and the second outlet for introducing and discharging the operating fluid.

The pumping system of the invention may also comprise the following optional features considered individually or according to all possible technical combinations:

The trigger is configured to be actuated by the drive piston at least when the latter is in one of its end positions.

The alternating distribution device comprises:

a first trigger configured to cause the alternating distribution device in its first arrangement when the drive piston reaches its first end position, and a second trigger configured to cause the alternating distribution device in its second arrangement when the drive piston reaches its second end position.

The movable shut-off members of the shut-off device are made up of guillotine valves which are movable between at least two positions, respectively a shutting-off position and an open position.

The two triggers are arranged on either side of the drive enclosure with respect to a transverse axis of said enclosure, each trigger comprising a rod which can be actuated by the drive piston, and movable between a rest position and an actuation position of an activation member connected to the movable members and configured to actuate them.

The alternating distribution device comprises:

a first activating member configured to simultaneously actuate the guillotine valves of the first and second fluid inlets arranged on the same side of the drive enclosure, said valves being interconnected longitudinally so that driving one of the valves towards one of its shutting-off or open positions drives the other valve to the opposite position, and a second activating member configured to actuate the guillotine valves of the first and second fluid outlets arranged on the same side of the drive chamber, said valves being interconnected longitudinally so that driving one of the valves towards one of its shutting-off or open positions drives the other valve to the opposite position.

Each activation member comprises a piston movable in a compression chamber provided with two pneumatic inlets connected respectively to the first and second trigger, and in that each trigger comprises a piston which is mechanically connected to the respective rod and movable in a compression chamber between a rest position and an actuation position of the piston of the respective activation member, the compression chamber of the trigger of which comprises two outputs respectively connected to the first and second activation members.

Each trigger comprises means for indexing the position of the movable shut-off members.

The rod of each trigger comprises means for returning said rod towards its rest position.

The multiplier pistons of the first and second multiplier chambers are arranged on respective first ends of a first shaft and a second shaft, wherein second ends of the respective first and second shafts are connected to the drive piston via universal joints or flexible connections.

The drive enclosure is generally cylindrical and includes domed ends arranged to withstand high pressures.

The invention also relates to a fluid delivery system provided in a body of water with a river current, comprising a Venturi tube immersed in the body of water so that the fluid pressure at the inlet of the tube is lower than the fluid pressure at the outlet of the tube, at least one sluice-type structure designed to channel and generate a laminar flow at the inlet and the outlet of the Venturi tube, and a pumping system according to any one of the preceding claims arranged such that the first and second fluid inlets of the pumping system are connected to the inlet of the Venturi tube and the first and second fluid outlets of the pumping system are connected to the outlet of the Venturi tube.

DISPLAY OF THE FIGURES

Other features and advantages of the invention will become apparent from the description given below with reference to the appended figures including but in no way limited to the following:

FIG. 4 is a sectional view of a pumping system according to a second embodiment;

FIG. 5 is a view according to the arrow V shown in FIG. 4;

FIG. 6 is a schematic view of a delivery system comprising the pumping system of the invention.

DETAILED DESCRIPTION OF THE INVENTION

It is first specified that in the figures, the same references designate the same elements whatever the figure on which they appear and whatever the form of representation of these elements. Similarly, if elements are not specifically referenced in one of the figures, their references can be easily retrieved by referring to another figure.

It is also specified that the figures essentially represent two embodiments of the subject matter of the invention but that there may be other embodiments that meet the definition of the invention.

The pumping system 1, 1 of the invention finds particular application in the field of delivery of a fluid such as water, using the driving power of a static or dynamic pressure column. The pumping system 1, 1 thus makes it possible to deliver this fluid from an area situated at a low altitude, called low point, to an area at a higher altitude, called high point. The pumping system 1, 1 is thus driven by a renewable energy.

The pumping system 1, 1*a* may further be integrated into a delivery installation 128 specially adapted to a river FL with a low current speed.

As a result of the description, the pumping system 1, 1*a* of the invention will be referred to as a "pump". "Delivery fluid" will be understood to be a fluid circulating in said pump 1, 1*a* intended to be delivered to the high point. Finally, "operating fluid" will indicate a fluid circulating in the pump 1, 1*a* to enable actuation, but this operating fluid is not intended to be delivered by the pump 1, 1*a* to the high point.

Figure 1:
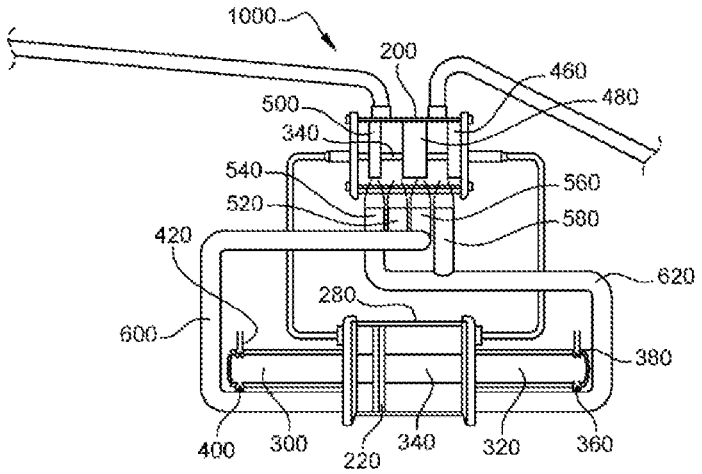
FIG. 1 is a cross-sectional view of a hydromechanical pump according to the prior art.
Figure 3:
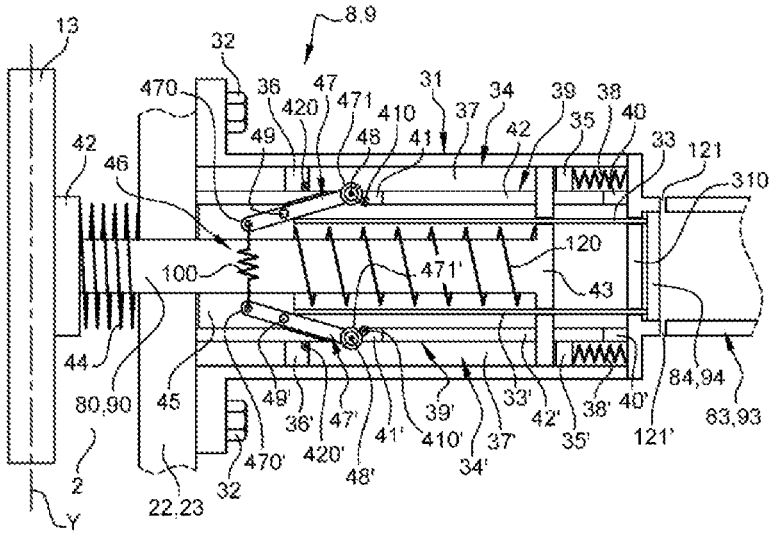
FIG. 3 is a sectional view of a detail of the pumping system of FIG. 1, representing the trigger.
Figure 2:
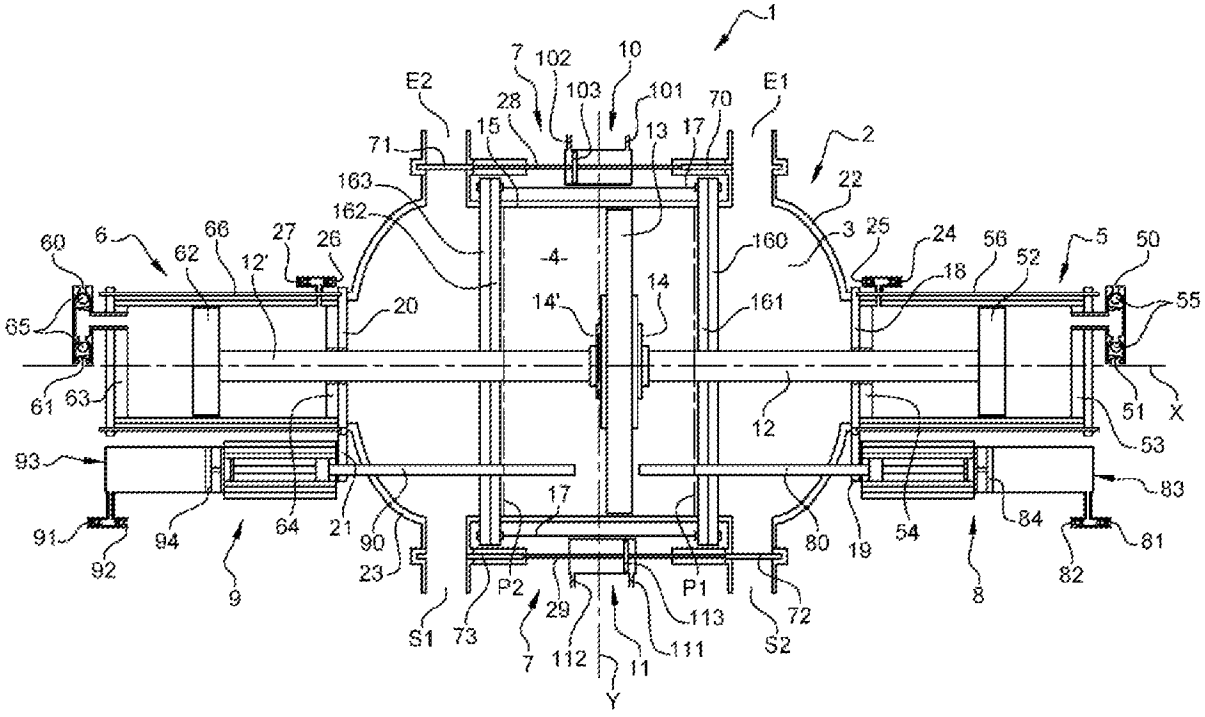
FIG. 2 is a sectional view of a pumping system according to a first embodiment.

With reference to FIGS. 2 and 3, the pump 1 in a first embodiment will now be described.

The pump 1 comprises a drive enclosure 2, preferably having a generally cylindrical shape, extending along a longitudinal axis X. Said drive enclosure 2 is closed at these axial ends by closure elements of the shield type 22, 23. Preferably, as shown in FIG. 2, these two shields 22, 23 are domed to better withstand the pressures exerted by the operating fluid moving in the drive enclosure 2. The drive enclosure 2 is thus formed by a cylindrical wall 15, the ends of which are closed by the domed walls 22, 23.

The drive enclosure 2 is further made of a metallic or composite material intended to withstand fluid pressures at least equal to three times the pressure of the pressure column.

The domed shields 22, 23 and the cylindrical portion 15 of the drive chamber 2 are connected together by annular flanges 160-163. Four annular flanges 160-163 are shown in FIG. 2: two flanges 160, 163 respectively secured to the circular cross-section ends of the domed shields 22, 23 and two flanges 161, 162 respectively secured to the opposite ends of the cylindrical portion 15. Finally, in order to reinforce the structure of the enclosure 2, the annular flanges 160-163 are further connected to one another by means of tie rods 17 connecting the opposite flanges 160-163 of the cylindrical part 15 of the drive enclosure 2. Preferably, these tie rods 17 are made of metallic material.

The drive enclosure 2 comprises first and second inputs E1, E2 of operating fluid opposite to a transverse axis Y, as well as first and second outlets S1, S2 of operating fluid opposite to the transverse axis Y. These inlets E1, E2 and outlets S1, S2 are provided in the cylindrical wall 15 of the enclosure 2. Furthermore, the inputs E1, E2 and the outputs S1, S2 are respectively provided on opposite edges of the drive enclosure 2 with respect to the longitudinal axis X.

The pump 1 comprises a drive piston 13 positioned inside the drive chamber 2 and configured to slide therein along the longitudinal axis X between first and second end positions P1, P2 under the effect of the operating fluid under pressure.

The drive piston 13 thus separates the drive chamber 2 into a first and a second drive chamber, the first and second operating fluid inlets E1, E2 respectively opening into the first and second drive chambers 3, 4, while the operating fluid is discharged from the first and second drive chambers 3, 4 respectively by the second and first fluid outlets S2, S1.

In order for the operating fluid to exert pressure on the drive piston 13, it is necessary for the fluid pressure at the first and second fluid inlets E1, E2 to be alternately higher than the fluid pressure at the first and second fluid outlets S1, S2. This pressure difference between the inlets E1, E2 and the fluid outlets S1, S2 is equal to the aforementioned pressure column. This manometric column can be static or dynamic.

The static pressure column is the column of water whose height is expressed by the difference between the altitude at which the fluid inlets E1, E2 are fluidically connected by at least one first duct (reference 129 in FIG. 6) and the altitude at which the fluid outlets e S1, S2 are fluidically connected by at least one second duct (reference 130 in FIG. 6). Typically, the second duct 130 is connected to water located in the low altitude zone while the first duct is connected to water located at higher altitude, this difference in altitude being sufficient to generate a water column capable of moving the drive piston 13.

A static pressure column is particularly feasible in mountainous streams, which flow along steep slopes.

If a watercourse flows along a gentle slope, it may be difficult, or even impossible to create a static pressure column strong enough to slide the drive piston 13. It is therefore necessary in this case to generate a dynamic pressure column. This will be addressed further along in the description, in connection with the delivery installation 28 shown in FIG. 6.

One advantage of the pump 1, 1*a* of the invention lies in particular in the possibility of adapting the height of the pressure column (static or dynamic) according to the desired operating fluid pressure. Depending on the desired height of the pressure column, it is intended to adapt the dimensions of the drive piston 13, the drive enclosure 2 and the other elements of the pump 1 in order to obtain sufficient delivery fluid pressure and necessary for the selected use, for example filtering water by nano filtration membrane within a water purification station, or implementing reverse osmosis filtration methods, which in particular make it possible to desalinate seawater.

These filtration methods (nano filtration and reverse osmosis) conventionally require a large amount of energy to operate. The pump 1, 1*a* according to the invention, operating using renewable energy, makes it possible to avoid the use of non-renewable energy and in particular fossil energy.

The movement of the drive piston 13 towards its first end position P1 or its second end position P2 depends on the operating fluid distribution cycle circulating in the drive enclosure 2.

Indeed, according to a first distribution cycle, the operating fluid circulates in the drive enclosure 2 from the first fluid inlet E1 opening into the first drive chamber 3, and is discharged by the first fluid outlet S1 from the second drive chamber 4. Under the pressure of the operating fluid during this first distribution cycle, the drive piston 13 then moves towards its second end position P2.

According to a second distribution cycle, the operating fluid circulates in the drive enclosure 2 from the second fluid inlet E2 opening into the second drive chamber 4, and is discharged by the second fluid outlet S2 from the first drive chamber 3. Under the pressure of the operating fluid during this second distribution cycle, the drive piston 13 then moves towards its first end position P1.

In order for these distribution cycles and especially their alternation to be possible, it is necessary to control, according to at least one determined sequence, the closing and the opening of the inlets E1, E2 and fluid outlets S1, S2 using an alternating distribution system. This point is discussed further hereinafter.

Advantageously, a seal (not shown), for example made of polytetrafluoroethylene, is mounted around the drive piston 13 so as to prevent the passage of the operating fluid from one drive chamber to the other 3, 4

The pump comprises a first and a second multiplier chamber 5, 6 arranged on either side of the drive enclosure 2 coaxially thereto. Each drive chamber 5, 6 is therefore rigidly connected to the respective domed shield 22, 23 via a flange 18, 20. The first multiplier chamber 5 is adjacent to the first drive chamber 3, while the second multiplier chamber 6 is adjacent to the second drive chamber 4. Advantageously, the multiplier chambers 5, 6 are cylindrical.

Each multiplier chamber 5, 6 comprises a multiplier piston 52, 62 configured to slide in said chamber along its longitudinal axis, i.e. along the longitudinal axis X. The multiplier piston of each multiplier chamber 5, 6 is rigidly connected to the end of a shaft 12, 12', said shaft being non-rigidly connected at its opposite end to the drive piston 13, for example via a flexible connection or a universal joint 14, 14'. The flanges 18, 20 rigidly connecting the multiplier chambers 5, 6 to the drive enclosure 2, as well as the end wall 54, 64 of each multiplier chamber 5, 6 rigidly connected to the respective flange 18, 20, have a bore hole to accommodate the respective shafts 12, 12'. Advantageously, the bore holes on the flanges 18, 20 and respective end walls of the multiplier chambers 5, 6 each comprise a sealed bearing (not shown) provided around the respective shaft 12, 12', in order to avoid fluid leaks between the drive enclosure 2 and the multiplier chambers 5, 6.

Advantageously, a seal (not shown), for example made of polytetrafluoroethylene, is mounted around each multiplier piston 52, 62 of the multiplier chambers 5, 6.

The drive piston 13 is connected to the two shafts 12, 12' respectively integral with the pistons 52, 62 of the first and second multiplier chambers 5, 6, this drive piston 13 subjected to the pressure of the operating fluid makes it possible to move the multiplier pistons 5, 6 of the multiplier chambers 5, 6 in order to allow the delivery of water out of said multiplier chambers 5, 6, as will be specified further hereinafter.

The first multiplier chamber 5 comprises a first inlet 50 and a first outlet fluid outlet 51, while the second multiplier chamber 6 comprises a second inlet 60 and a second outlet fluid outlet 61. The first delivery fluid inlets 50, 60 are preferably connected to the first duct 129 allowing the admission of operating fluid into the drive enclosure 2, but can also be connected to another fluid source, in particular the effluents from a purification station connected to the pump 1.

For each multiplier chamber 5, 6, the inlet 50, 60 and the outlet 51, 61 are preferably provided on the free end wall 53, 63 of the respective multiplier chamber 5, 6, in order to allow the filling or emptying of the portion of the multiplier chamber 5, 6 comprised between the piston 52, 62 and the end wall 53, 63. Preferably, the inlets 50, 60 and outlets 51, 61 of discharge fluid comprise check valves, for example ball valves 55, 65.

Furthermore, in order to allow the movement of the multiplier piston 52, 62 of each multiplier chamber 5, 6, it is necessary to provide pneumatic inputs 24, 26 and outlets 25, 27 for each multiplier chamber 5, 6, preferably formed in the cylindrical wall 56, 66 of each chamber 5, 6 in the vicinity of the respective flange 18, 20. Indeed, the portion of the multiplier chamber comprised between the multiplier piston 52, 62 and the end wall 54, 64 of the respective multiplier chamber 5, 6 is filled with gas, in particular air. The pneumatic inputs 24, 26 and outlets 25, 27 make it possible to avoid overpressure and underpressure during the movement of the respective multiplier piston 52, 62, making possible non-constrained movement of said piston 52, 62.

Thus, when the piston 52, 62 of the first multiplier chamber 5, respectively of the second multiplier chamber 6, moves towards the drive enclosure 2, gas exits from the respective multiplier chamber 5, 6 through the respective pneumatic outlet 25, 27 and the delivery fluid enters this chamber 5, 6 via the first inlet 50, respectively the second inlet 60, provided on the end wall 53, 63 of the respective multiplier chamber 5, 6.

Conversely, when the piston 52, 62 of the first multiplier chamber 5, respectively the second multiplier chamber 6, moves away from the drive enclosure 2 to deliver the delivery fluid, gas enters the respective multiplier chamber 5, 6 through the respective pneumatic inlet 24, 26 and the delivery fluid exits from this chamber 5, 6 via the first outlet 51, respectively the second outlet 61, provided on the end wall 53, 63 of the respective multiplier chamber 5, 6.

As illustrated in FIG. 2, the cross-sectional area of the multiplier chambers 5, 6 is smaller than the cross-sectional area of the cylindrical wall 15 of the drive enclosure 2. Hereby, the outlet discharge fluid pressure 51, 61 of each multiplier chamber 5, 6 is much higher than the operating fluid pressure exerted on the drive piston 13. This high fluid pressure at the outlet 51, 61 of the multiplier chambers 5, 6 allows the fluid to be delivered at a high point the altitude of which is higher than that of the pressure column.

The ratio between the two cross sections respectively of the multiplier chambers 5, 6 and of the drive enclosure 2 is chosen according to the desired use. By way of example, it is necessary to obtain a delivery fluid pressure of the order of 15 to 20 bars in order to allow the implementation of a nano membrane filtration process, while a delivery fluid pressure of between 50 and 80 bars is required for implementing a reverse osmosis process.

Thus, the dimensions of the drive enclosure 2 and of the drive piston 13 will be chosen according to the water pressure column, and the ratio between the two sections will be chosen according to the desired use. In addition, for this dimensioning, losses of loads caused by friction dissipating the mechanical energy of the moving fluid are also taken into account. Finally, the thrust force of the drive piston 13 should be taken into account in order to prevent the opposite force generated by the delivery or compression work generated by the multiplier pistons 52, 62 cancels the thrust force of the drive piston 13, and this in order to allow, in the end, the sliding of the drive piston 13 in the drive enclosure 2.

The design of the pumping system 1, 1*a* of the invention can be adapted according to the desired gauge column, it is conceivable to design such a pump 1, 1*a* of large size, allowing the production of water under pressure of several tens of thousands of cubic meters per day, representing the consumption of the population equivalent of an average city.

With reference to FIG. 2 and according to the invention, the alternating distribution device will now be described.

The alternating distribution device comprises a shutting-off device 7 comprising four shutting-off members 70-73, respectively provided at the first and second operating fluid inlets E1, E2 and the first and second operating fluid outlets S1, S2.

Each shutting-off member 70-73 is made up of a knife gate valve movable between a closed position and an open position. The valves 70, 71 of the inlets E1, E2 of the drive enclosure 2 are connected longitudinally to one another, for example, by means of a cable or a connecting rod 28, so that the driving of one of the valves 70, 71 towards one of its closing or opening positions drives the other valve 70, 71 to the opposite position. Similarly, the valves 72, 73 of the outputs S1, S2 of the drive enclosure are connected longitudinally to one another, for example, by means of a cable or a connecting rod 29. Preferably, each knife gate valve 70-73 comprises a gate leaf (references 700, 710, 720 and 730 in the FIG. 4), i.e. a through hole, which is aligned with the inlet E1, E2 or the outlet S1, S2 considered when said valve 70-73 is in the open position.

This type of valve 70-73, the gate leaf 700, 71, 720, 730 of which passes perpendicularly through the flow of liquid in the open position, has better resistance to the static or dynamic pressure of the fluid.

The shutting-off device 7 comprises a first and a second activation member 10, 11. The first activating member 10 is configured to simultaneously actuate the valves 70, 71 of the first and second inlets E1, E2 of the drive enclosure 2, while the second activating member 11 is configured to simultaneously actuate the valves 72, 73 of the first and second outlets S1, S2 of the drive enclosure 2.

The first activation member 10, respectively the second activation member 11, comprises a first, respectively, a second, cylindrical activation chamber closed at its ends and in which a first 103, respectively a second 113 activation piston slides. Finally, each activation member 10, 11 comprises first 101, 102 and second 111, 112 pneumatic inputs provided on the cylindrical wall of the activation chamber, in the vicinity of the opposite ends of the respective activation member 10, 11.

For the first activation member 10, the activation piston 103 is rigidly connected to the longitudinal link 28 between the two knife gate valves in question 70, 71, so that the movement of the piston 103 towards the first pneumatic inlet 101 of the activation member simultaneously induces the closing of the first inlet E1 of the drive enclosure 2 and the opening of the second inlet E2 of the drive enclosure 2.

For the second shutting-off member 1, the activation piston 113 is also rigidly connect to the longitudinal link 29 between the two knife gate valves in question 72, 73, so that the movement of the piston 113 towards the first pneumatic inlet 112 of the activation member 11 simultaneously induces the shutting off of the first outlet S1 of the drive enclosure 2 and the opening of the second outlet S2 of the drive enclosure 2.

Finally, the alternating distribution device comprises first and second triggers 8, 9 configured to actuate the first and second activation members 10, 11.

The triggers 8, 9 are provided on either side of the drive enclosure 2 with respect to the transverse axis Y and are respectively rigidly connected to the domed shields 22, 23 via flanges 19, 21 provided for this purpose. Each trigger 8, 9 comprises a pneumatic compression chamber 83, 93 in which a trigger piston 84, 94 is arranged to slide along the longitudinal axis of the compression chamber 83, 93 between a rest position and a trigger position. The compression chamber 83, 93 of each trigger 8, 9 further comprises two outlets 81, 82, 91, 92 for gas, preferably air, connected to the pneumatic inlets 101, 102, 111, 112 of the activation members 10, 11. Finally, the compression chamber 83, 93 comprises at least one exhaust port (references 121, 121' in FIG. 3) forming a vent provided in the cylindrical wall of the chamber 83, 93 to allow the circulation of air between said chamber 83, 93 and the outside when the piston 84, 94 moves. This prevents creation of overpressure and mechanical opposition to the movement of the piston 84, 94.

The air outlets 81, 82 of the first trigger 8 are respectively connected to the first pneumatic inlets 101, 112 of the first and second activation members 10, 11. The air outlets 91, 92 of the second trigger 9 are respectively connected to the second pneumatic inputs 102, 111 of the first and second activation members.

Thus, in order to cause actuation of the alternating distribution device:

- the movement of the piston 83 of the first trigger 8 towards its triggering position induces the actuation of the pistons 103, 113 of the activation members 10, 11, the pistons 103, 113 of which move and cause the second inlet and outlet E2, S2 of the drive enclosure 2 to shut off and the first inlet and outlet E1, S1 of the drive enclosure 2 to close. The alternating distribution device is therefore in its first arrangement associated with the first distribution cycle;
- the movement of the piston 93 of the second trigger 9 towards its triggering position induces the actuation of the pistons 103, 113 of the activation members 10, 11, said pistons 103, 113 move and cause the first inlet and outlet E1, S1 of the drive enclosure 2 to shut off and the second inlet and outlet E2, S2 of the drive enclosure 2 to open. The alternating distribution device is therefore in its second arrangement associated with the second distribution cycle.

Each trigger 8, 9 further comprises a rod 80, 90 that can be actuated by the drive piston 13, said rod 80, 90 is movable between a rest position in which the respective trigger 8, 9 is inactive, and an actuation position of the activation member 10, 11. When the drive piston 13 induces the movement of the rod 80, 90 towards its actuation position, the piston 83, 93, 84, 94 of the associated trigger 8, 9 then moves to its trigger position.

Thus, when the alternating distribution device is in its first arrangement associated with the first operating fluid distribution cycle, the valves 70, 73 of the first inlet and outlet E1, S1 of the drive enclosure 2 are in their open position while the valves 71, 72 of the second inlet and outlet E2, S2 of the drive enclosure 2 are in their shut-off position. The operating fluid pressure in the drive enclosure 2 then induces the movement of the drive piston 13 towards its second end position P2. Delivery fluid then exits the second multiplier chamber 6.

Once this second end position P2 of the drive piston 13 is reached, the latter actuates the rod 90 of the second trigger 9, which induces the delivery of the piston 94 of said second trigger 9 in the pneumatic chamber 93 towards its trigger position. Pressurized air is sent to the second pneumatic inlets 102, 111 of the two activation members 10, 11, which induces the movement of the pistons 103, 113 of said activation members causing the knife gate valves 70-73 to move towards their shut-off positions of the first inlet and outlet E1, S1 of the drive enclosure 2 and of the open position of the second inlet and outlet E2, S2 of the drive enclosure 2.

The alternate distribution device is then in its second arrangement associated with the second operating fluid distribution cycle. The operating fluid pressure in the enclosure 2 then induces the movement of the drive piston 13 towards its first end position P1. The delivery fluid then exits from the first multiplier chamber 5.

Once this first end position P1 of the drive piston 13 is reached, the latter actuates the rod 80 of the first trigger 8, which induces the movement of the piston 84 of said first trigger 8 in the pneumatic chamber 83 towards its trigger position. Pressurized air is sent to the first pneumatic inlets 101, 112 of the two activation members 10, 11, which induces the movement of the pistons of said activation members causing the knife gate valves 70-73 to move to their shutting-off position of the second inlet and outlet E2, S2 of the drive enclosure 2 and the open position of the first inlet and outlet E1, S1 of the drive enclosure 2.

The alternate distribution device is then in its first arrangement associated with the first operating fluid distribution cycle, and then the alternation of cycles resumes.

By virtue of the triggers 8, 9 and the shut-off device 7, the alternating distribution device can therefore be actuated between a first arrangement associated with the first fluid distribution cycle, and a second arrangement associated with the second fluid distribution cycle.

With reference to FIG. 3, the trigger 8, 9 will now be described.

The trigger 8, 9 comprises a parallelepiped body 31, an end wall 310 of which is rigidly connected to the drive enclosure 2 via the flange described above. Alternatively, as shown in FIG. 3, this parallelepipedal body is directly bolted 32 to the shield 22, 23 of the drive enclosure 2. The shield 22, 23 or the flange comprises a bore hole so the rod 80, 90 can be placed into the drive enclosure 2.

A first free end of the rod comprises a skirt 42 intended to come into contact with the drive piston 13. Furthermore, the rod 80, 90 comprises a return means 44 towards its rest position, which return means 44 is formed, for example, by a coil spring mounted around the rod 80, 90 coaxially and the end of which bears against the shield 22, 23 of the drive enclosure 2 and the shoulder surface formed by the skirt 42.

Finally, the rod 80, 90 comprises at its free end a plate-shaped guide 43 which extends transversely to the axis of the rod 80, 90 on either side of the latter.

The trigger 8, 9 comprises two plates 39, 39' provided in the parallelepiped body 31 on either side of the rod 80, 90, parallel to the latter. The distance between the two plates 39, 39' is less than the length of the guide 43. Each plate 39, 39' thus comprises at least one longitudinal slot 42, 42" provided between its ends 40, 41; 40', 41' in order to accommodate the free ends of the guide 43 and allow the rod 80, 90 to slide between its rest and actuation positions. The two plates thus form slides 39, 39'. Furthermore, the first ends 40, 40' of the slides are rigidly connected to the end wall 310 of the parallelepiped body 31.

The trigger 8, 9 comprises two unlocking elements 34, 34' mounted movably in longitudinal sliding in the parallelepiped body 31, on either side of the rod 80, 90, between a rest position (shown in FIG. 3) and an unlocking position. Each unlocking element 34, 34' is plate-shaped and is slidable between one of the longitudinal walls of the parallelepiped body 31 and one of the slides 39, 39'. Each unlocking element 34, 34' further comprises a longitudinal slot 37, 37' for accommodating the free ends of the guide 43 and to allow the longitudinal movement of the rod 80, 90.

Furthermore, the trigger 8, 9 comprises return means 38, 38' of the unlocking elements 34, 34' in the rest position thereof, i.e. at a distance from the end wall of the parallelepiped body 31 rigidly connected to the compression chamber 83, 93. These return means 38, 38' are, for example, coil springs. In its unlocking position, the unlocking element 34, 34' is therefore closest to the aforementioned end wall because the spring 38, 38' is in a compressed state.

The guide 43 of the rod 80, 90 of the trigger 8, 9 is configured to move the unlocking elements 34, 34' to their unlocking position. Indeed, when the rod 80, 90 moves to its actuating position, the guide 43 exerts a pressure on first free ends 35, 35' of the respective unlocking elements 34, 34', inducing the movement of said unlocking elements 34, 34' to their unlocking position.

The trigger 8, 9 further comprises a driving element 45 preferentially having a parallelepipedal shape mounted around the rod 80, 90, in sliding contact with the slides 39, 39'. This driving element 45 is movable between an inactive position (shown in FIG. 2) and a trigger position. This element 45 is made of an anti-friction material of the polytetrafluoroethylene (PTFE) type, or else of metal covered with an anti-friction material.

In the inactive position, the driving element 45 is pressed against the respective shield 22, 23 of the drive enclosure 2, or, if necessary, against the flange connecting the trigger 8, 9 to the drive enclosure 2. In the trigger position, the driving element 45 is in a position far away from the shield 22, 23 or from the aforementioned flange.

The trigger 8, 9 comprises two pins 33, 33' rigidly connect to the driving element 45 and extending longitudinally on either side of the rod 80, 90. These pins 33, 33' pass through the bore hole provided in the guide 43 and into the end wall of the parallelepiped body 31 in order to open into the compression chamber 83, 93 of the trigger 8, 9. The free ends of these pins 33, 33' are rigidly connected to the pneumatic piston 84, 94 of the trigger 8, 9. Movement of the driving element 45 to its trigger position thus causes the pneumatic piston 84, 94 to move to its trigger position.

The trigger 8, 9 further comprises a return member 120 of the driving element 45 towards its trigger position. This return member is, for example, a coil spring mounted around the rod 80, 90 coaxially and the ends of which are rigidly connected respectively to the driving element 45 and the guide 43.

Thus, in its inactive position and when the rod 80, 90 moves to its trigger position, the guide 43 exerts a tension on the return spring 120 which is then expanded and tends to bring the driving element 45 to its trigger position. In order to allow the driving element 45 to be held in its inactive position despite the tension of the spring 120, the trigger 8, 9 includes indexing means 46 which will now be described with reference to FIG. 3.

The indexing means 46 comprise at least two indices 47, 47' formed by tabs pivotally mounted around pivot points 49, 49' on a lateral face of the driving element 45, said face extending in a plane parallel to the transverse axis Y. Each index 47, 47' comprises a first free end 470, 470' opposite the aforementioned lateral face, and a second free end 471, 471' away from the driving element 45 and extending towards the slides 39, 39'.

The first free ends 470, 470' of the indices 47, 47' are interconnected by a return member 100 of said indices in a so-called opened position (as shown in FIG. 2): this return member 46, for example a spring, exerts a tension which brings the first free ends towards the first free ends 470, 470 of the indices 47, 47' therebetween and away from the second free ends 471, 471' of the indices therebetween.

In the spacing position of the indexing means 46, a portion comprising the second free end 471, 471' of each index 47, 47' is comprised in a housing provided in each slide 39, 39'. Furthermore, the second free end 471, 471' of each index 47, 47' bears against a free end 41, 41' forming an abutment of each slide 39, 39'. In excess, the free ends 471, 471 of indices 47, 47' are housed in the slots 37, 37' of the unlocking elements 34, 34'. In this way, in the open position, the indices 47, 47' block the driving element 45 in its inactive position.

When the rod 80, 90 of the trigger 8, 9 moves to its trigger position and causes the unlocking elements 34, 34' to slide to their unlocking position, second free ends 36, 36' of said unlocking elements 34, 34', opposite the first free ends 35, 35', bear against the second free ends 471, 471' of the indices 47. This causes the indices 47, 47' to pivot and move closer to each other from their second free ends 471, 471'. To facilitate the sliding of the second free ends 471, 471' of the indices 47, 47' along the stops 41, 41' of the slide 39, 39', each second free end 471, 471' of the indices 47, 47' comprises a bearing 48, 48'. Preferably, the slide stops 41, 41' and the second free ends 36, 36' of the unlocking elements also comprise bearings 410, 410', 420, 420'.

When the indices 47, 47' arrive at a sufficiently closed position between their second free ends 470, 471', the latter are no longer bearing against the slide stops 41, 41', which results in the release of the driving element 45 which slides abruptly, under the effect of the respective return spring 120, from its inactive position to its trigger position. This directly induces the sliding of the pins 33, 33' and the concomitant movement of the piston 84, 94 of the trigger 8, 9 in the compression chamber 83, 93 from its rest position to its trigger position.

Thus, when the alternate distribution device is in its first arrangement associated with the first operating fluid distribution cycle, the drive piston 13, which moves to its second end position P2, moves the rod 90 of the second trigger 9 towards its trigger position. This induces the release of the indices 47, 47' towards their position of coming together and the abrupt sliding of the driving element 45 towards its triggering position. Concomitantly, the piston 94 of the trigger 9 moves to its trigger position. The alternate distribution device is then found, following actuation of the activation members 10, 1, which drive the delivery of the knife gate valves 70-73, in its second arrangement associated with the second operating fluid distribution cycle.

The drive piston 13 which moves to its first end position P1 releases the rod 90 of the second trigger 9 which moves, due to the respective return means 44, to its rest position. Similarly, the unlocking elements 34, 34' slide, under the effect of the return members 38, 38', towards their rest position.

Concomitantly with the movement of the rod 90, the guide 43 exerts a compressive force on the return spring 120 of the driving element 45, which induces the movement of said driving element 45 to its inactive position and then the movement of the indices 47, 47' to their opened position, blocking the driving element 45 in its inactive position as soon as the second free ends 471, 471' of the indices 47, 47' are housed in the housings of the slides 39, 39' provided for this purpose.

The drive piston 13 reaches its first end position P1 and actuates the rod 80 of the first trigger 8, which is actuated in the same manner as the second trigger 9.

The alternate distribution device is then in its first arrangement associated with the first operating fluid distribution cycle, and then the alternation of cycles begins.

With reference to FIGS. 4 and 5, the pumping system 1*a* according to a second embodiment will now be described.

The drive enclosure 2*a* in this second embodiment has an identical shape, at the difference near that the shields 22*a*, 23*a* are preferably planar walls.

The main difference in this second embodiment resides in the activating members 10*a*, 11*a* which are in this case two tilting lever members arranged at the shields 22*a*, 23*a* of the drive enclosure 2*a* on either side of a transverse axis Y of said drive enclosure 2*a*.

Referring to FIG. 5, each tilting lever 10*a*, 11*a* comprises a main portion of a substantially oval shape, with two parallel rectilinear arms 121, 121' extending in the plane containing the transverse axis Y, on either side of the respective multiplier chamber 5*a*, 6*a*. The two arms 121, 121' of a tilting lever 10*a*, 11*a* are connected to one another at their opposite ends by two curved arms 122, 122'.

Each rectilinear arm 121, 121' is pivotally connected, at a central portion of said arm 121, 121', to the respective shield 22*a*, 23*a* of the drive enclosure 2*a* via a rectilinear connecting element 124, 124' extending perpendicular to said shield 22*a*, 23*a*.

Each curved arm 122, 122' comprises a projection 123, 123' extending from the central portion of the convex portion of the curved arm 122, 122', in the main plane of the tilting lever 10*a*, 11, the free end of this projection being pivotally connected to a rectilinear connecting element 125, 125'; 126, 126' (see FIG. 4), rigidly connected to the knife gate valves 70*a*-73*a*, said connecting element 125, 125'; 126, 126' being in the extension of the cable or of the connecting rod 28*a*, 29*a* ensuring the connection of two knife gate valves 70*a*-73*a* therebetween.

Thus, each tilting lever 10*a*, 11 pivotally connected to the respective shield 22*a*, 23*a* is also connected by the two opposite projections 123, 123' to the four knife gate valves 70*a*-73*a*, via the cables or connecting rods 28*a*, 29*a*. The tilting lever 10*a*, 11*a* thus can pivot between a first position moving the knife gate valves 70*a*-73*a* to their positions corresponding to the first fluid distribution cycle, and a second position moving the knife gate valves 70*a*-73*a* to their positions corresponding to the second fluid distribution cycle.

Preferably, the pivoting of the tilting lever 10*a*, 11*a* is actuated by the respective trigger 8*a*, 9*a*. The structure of this trigger 8*a*, 9*a* is slightly different in that it does not comprise a compression chamber, and in that the driving element 45*a* is connected to the respective tilting lever 10*a*, 11*a*, for example by means of connecting rods 127 rigidly connected to one of the curved arms 122'.

In the embodiment of FIG. 4, a first tilting lever 10*a* is connected by one of its curved arms 122' to the first trigger 8*a*, while a second tilting lever 11*a* is connected by one of its curved arms 122' to the second trigger 9*a*.

When the alternating distribution device is in its arrangement associated with the second distribution mode, i.e. the knife gate valves 70*a*-73*a* are in their shutting-off positions of the first inlet and outlet E1*a*, S1*a* of the drive enclosure 2*a* and their opening positions of the second inlet and outlet E2*a*, S2*a* of the drive enclosure 2*a*, the drive piston 13*a* moving towards its first end position.

In this first end position, the drive piston 13*a* actuates the first trigger 8*a*. This induces the movement of the driving element 45*a* which actuates, via the connecting rods 127, the pivoting of the first tilting lever 10*a*. This causes the knife gate valves 70*a*-73*a* to move to their position for shutting off the second inlet and outlet E2*a*, S2*a* of the drive enclosure 2*a* and for opening the first inlet and outlet E1*a*, S1*a* of the drive enclosure 2*a*. The alternate distribution device is in its arrangement associated with the first distribution cycle, the drive piston 13*a* then moving towards its second end position.

In this second end position, the drive piston 13*a* actuates the second trigger 9*a*. This induces the movement of the driving element 45*a* which actuates, via the links 127, the tilting of the second tilting lever 11*a*. This causes the knife gate valves 70*a*-73*a* to move to their position for shutting off the first inlet and outlet E1*a*, S1*a* of the drive enclosure 2*a* and for opening the second inlet and outlet E1*a*, S2*a* of the drive enclosure 2*a*. The alternate distribution device is in its arrangement associated with the second distribution cycle, the drive piston 13*a* then moving to its first end position. Then, the alternation of cycles resumes.

Alternatively, the tilting levers 10*a*, 11*a* may be connected to the pneumatic outlets 25, 27 of the multiplier chambers: the tilting levers 10*a*, 11*a* are then activated by pressurized air generated by the movement of the associated multiplier piston. This compressed air is led to a valve (not shown) placed on the respective trigger 8*a*, 9*a*. By the action of the driving element 45, this valve is opened to allow the compressed air to actuate the respective tilting lever 10*a*, 11*a*. Furthermore, the connecting rods 127 of the triggers 8*a*, 9*a* are telescopic so as to be able to return to a rest position when triggering the opposite trigger 8*a*, 9*a* which pivots the tilting levers 10*a*, 11*a* towards their opposite position.

Referring to FIG. 6, the delivery installation 128 according to the invention will now be described.

This installation 128 finds its use in slow-current rivers, flowing along gentle slopes.

Indeed, for this type of river, it is very difficult or impossible to generate a static pressure column of sufficient height to allow the operation of the pump 1, 1*a*, since it would be necessary to capture the fluid very far upstream, typically at several kilometers from the inlet of the pump 1, 1*a*. In the remainder of the description, the term "river" will be used hereinafter.

The delivery installation 128 makes it possible to create a dynamic pressure column, generating a fluid pressure sufficient to ensure the delivery of the drive piston 13, 13*a* and the operation of the pump 1, 1*a*.

The installation 128 comprises a Venturi tube 140, formed by first 141 and second frustoconical ducts 142 mounted head-to-tail to a cylindrical duct 143: the small bases of the first and second frustoconical ducts 141, 142 are therefore rigidly connected to the respective ends of the cylindrical duct 143. The large base of the first frustoconical duct 141 is defined as the inlet 144 of the Venturi tube 140, while the large base of the second frustoconical duct 142 is defined as the outlet 145 of the Venturi tube 140.

The Venturi tube is arranged in the river FL parallel to the current C, so that the water of the river FL enters the Venturi tube 140 via the first frustoconical duct 141 and comes out via the second frustoconical duct 142.

In order to generate a Venturi effect in the Venturi tube 140, the section of the large base of the first frustoconical duct 141 is greater than the cross-section of the cylindrical duct 143. The inlet fluid pressure 144 of the Venturi tube 140 is therefore greater than the fluid pressure in the cylindrical duct 143, said fluid pressure in the cylindrical duct 143 being sufficient to allow uses implementing nano filtration processes, i.e. between 15 bars and 20 bars, or of reverse osmosis, i.e. between 50 bars and 80 bars.

Furthermore, to generate an optimal Venturi effect, the angle formed between the axis of the cylindrical duct 143 and any line of intersection between the frustoconical wall of each duct 141, 142 and a plane passing through the axis of said cylindrical duct is 6 degrees.

The first duct 129 connected to the first and second inlets E1, E2; E1*a*, E2*a* of the pump 1, 1*a* captures the fluid at the inlet 144 of the Venturi tube 140, while the second duct 130 connected to the first and second outlet S1, S2; S1*a*, S2*a* of the pump 1, 1*a* is in fluid communication with the water circulating in the cylindrical duct 143. The pressure difference between the inlets E1, E2; E1*a*, E2*a* and the outlets S1, S2; S1*a*, S2*a* of the pump 1, 1*a* is therefore equivalent to a dynamic pressure column resulting from the difference between the inlet fluid pressure 144 of the Venturi tube 140 and the fluid pressure in the cylindrical duct 143. With the structural conditions of the Venturi tube described above, the dynamic pressure column generated is sufficient to allow the movement of the drive piston 13, 13*a* and the operation of the pump 1, 1*a* in uses implementing reverse osmosis processes.

Finally, the fluid inlets 50, 60; 50*a*, 60 arranged in the end walls of the multiplier chambers 5, 6; 5*a*, 6*a* are in fluid communication with the outlet 145 of the Venturi tube 140, at the free end of the second frustoconical duct 142.

Advantageously, in order to further increase the dynamic pressure at the inlet 144 of the Venturi tube 140, a sluice-type masonry structure 146 is provided at the bank to channel the flow of part of the river to the inlet 144 of the Venturi tube 140. This results in the more laminar flow at the inlet 144 of the Venturi tube 140 and avoiding the formation of vortices or other turbulence. In addition, this makes it possible to further increase the fluid speed, and therefore the dynamic pressure of the fluid, at the inlet 144 of the Venturi tube 140.

Preferably, the delivery installation 128 comprises a second masonry structure of the sluice 147 type provided at the outlet of the Venturi tube 140. This structure 147 makes it possible to progressively slow the flow at the outlet 145 of the Venturi tube 140 and to gradually slow down the speed to the flow velocity of the river FL. Thus, the formation of turbulence at the outlet 145 of the Venturi tube 140 is avoided.

The invention claimed is:

1. Pumping system for the delivery of a pressurized fluid, comprising:

a drive chamber inside which is positioned a drive piston configured to slide therein along a longitudinal axis of a drive enclosure between first and second end positions under the effect of a pressurized operating fluid, the driving piston separating said drive enclosure into a first driving chamber and a second driving chamber, a first multiplier chamber and a second multiplier chamber comprising an inlet and an outlet for, respectively, receiving and discharging a delivery fluid, a first multiplier piston, connected to the driving piston and configured to slide within the first multiplier chamber, the sliding of the first multiplier piston ensuring the compression of the delivery fluid inside the first multiplier chamber such that the pressure of the delivery fluid at the outlet is greater than the pressure of the delivery fluid at the inlet of the first multiplier chamber, a second multiplier piston, connected to the drive piston and configured to slide within the second multiplier chamber, the sliding of the second multiplier piston ensuring the compression of the delivery fluid inside the second multiplier chamber such that the pressure of the delivery fluid at the outlet is greater than pressure at the inlet of the second multiplier chamber, an alternating fluid distribution device for alternating the direction of circulation of the operating fluid in the drive enclosure, the pumping system comprising a first fluid inlet opening into the first drive chamber and a first fluid outlet from the second drive chamber for, respectively, receiving and discharging the operating fluid during a first distribution cycle, and that it comprises a second fluid inlet opening into the second drive chamber and a second fluid outlet from the first drive chamber for, respectively, receiving and discharging the operating fluid during a second distribution cycle, and in that the alternating distribution device comprises at least one shutting-off device comprising four movable shutting-off members of the first and second inlets and first and second outlets of the pumping system and at least one trigger configured to actuate said shutting-off members between two respectively shutting-off and open positions, said alternating distribution device can be actuated between:

a first arrangement associated with the first distribution cycle in which the drive piston moves to its second end position, two of the movable members respectively shut off the second inlet and the second fluid outlet, and the other two movable members respectively open the first inlet and the first fluid outlet to ensure the insertion and discharge of the operating fluid, and a second arrangement associated with the second distribution cycle in which the drive piston moves to its first end position, two of the movable members respectively shut off the first inlet and the first outlet, and the other two movable members respectively open the second inlet and the second outlet to ensure the insertion and discharge of the operating fluid; and wherein the movable shutting-off members of the shutting-off device are made up of knife gate valves movable between at least two respectively shutting-off and open positions.

2. Pumping system according to claim 1, wherein the trigger is configured to be actuated by the drive piston at least when the latter is in one of its end positions.

3. Pumping system according to claim 1, wherein the alternating distribution device comprises:

a first trigger configured to put the alternating distribution device into its first arrangement when the drive piston reaches its first end position 1, and a second trigger configured to put the alternating distribution device into its second arrangement when the drive piston reaches its second end position.

4. Pumping system according to claim 3, wherein the two triggers are arranged on either side of the drive enclosure with respect to a transverse axis of said enclosure, each trigger comprising a rod which can be actuated by the drive piston, and movable between a rest position and an actuation position of an activation member connected to the movable members and configured to operate them.

5. Pumping system according to claim 1, wherein each trigger comprises means for indexing the position of the movable shutting-off members.

6. Pumping system according to claim 4, wherein the rod of each trigger comprises means for returning said rod to its rest position.

7. Pumping system according to claim 1, wherein the multiplier pistons of the first and second multiplier chambers are arranged on respective first ends of a first shaft and a second shaft, second ends of the respective first and second shafts being connected to the drive piston via universal joints or flexible connections.

8. Pumping system according to claim 1, wherein the drive enclosure is generally cylindrical in shape and comprises domed ends arranged to resist fluid pressures above several bars.

9. Fluid delivery installation provided in a body of water with a river current (C), comprising a Venturi tube immersed in the body of water so that the fluid pressure at the inlet of the tube is lower than the fluid pressure at the outlet of the tube, at least one sluice-type structure arranged to channel and generate a laminar flow at the inlet and the outlet of the Venturi tube, and a pumping system according to claim 1 arranged such that the first and second fluid inlets of the pumping system are connected to the inlet of the Venturi tube and the first and second fluid outlets of the pumping system are connected to the outlet of the Venturi tube.

10. Pumping system for the delivery of a pressurized fluid, comprising:

a drive chamber inside which is positioned a drive piston configured to slide therein along a longitudinal axis of a drive enclosure between first and second end positions under the effect of a pressurized operating fluid, the driving piston separating said drive enclosure into a first driving chamber and a second driving chamber, a first multiplier chamber and a second multiplier chamber comprising an inlet and an outlet for, respectively, receiving and discharging a delivery fluid, a first multiplier piston, connected to the driving piston and configured to slide within the first multiplier chamber, the sliding of the first multiplier piston ensuring the compression of the delivery fluid inside the first multiplier chamber such that the pressure of the delivery fluid at the outlet is greater than the pressure of the delivery fluid at the inlet of the first multiplier chamber, a second multiplier piston, connected to the drive piston and configured to slide within the second multiplier chamber, the sliding of the second multiplier piston ensuring the compression of the delivery fluid inside the second multiplier chamber such that the pressure of the delivery fluid at the outlet is greater than pressure at the inlet of the second multiplier chamber, an alternating fluid distribution device for alternating the direction of circulation of the operating fluid in the drive enclosure, the pumping system comprising a first fluid inlet opening into the first drive chamber and a first fluid outlet from the second drive chamber for, respectively, receiving and discharging the operating fluid during a first distribution cycle, and that it comprises a second fluid inlet opening into the second drive chamber and a second fluid outlet from the first drive chamber, for, respectively, receiving and discharging the operating fluid during a second distribution cycle, and in that the alternating distribution device comprises at least one shutting-off device comprising four movable shutting-off members of the first and second inlets and first and second outlets of the pumping system and at least one trigger configured to actuate said shutting-off members between two respectively shutting-off and open positions, said alternating distribution device can be actuated between:

a first arrangement associated with the first distribution cycle in which the drive piston moves to its second end position, two of the movable members respectively shut off the second inlet and the second fluid outlet, and the other two movable members respectively open the first inlet and the first fluid outlet to ensure the insertion and discharge of the operating fluid, and a second arrangement associated with the second distribution cycle in which the drive piston moves to its first end position, two of the movable members respectively shut off the first inlet and the first outlet, and the other two movable members respectively open the second inlet and the second outlet to ensure the insertion and discharge of the operating fluid, wherein the alternating distribution device comprises:

a first activation member configured to simultaneously actuate the knife gate valves of the first and second fluid inlets arranged on the same side of the drive enclosure, said valves being interconnected longitudinally such that the driving of one of the valves towards one of its shutting-off or open positions drives the other valve in the opposite position, and a second activating member configured to actuate the knife gate valves of the first and second fluid outlets arranged on a same side of the driving enclosure, said valves being interconnected longitudinally such that the driving of one of the valves towards one of its shutting-off or open positions drives the other valve in the opposite position.

11. Pumping system for the delivery of a pressurized fluid, comprising:

a drive chamber inside which is positioned a drive piston configured to slide therein along a longitudinal axis of a drive enclosure between first and second end positions under the effect of a pressurized operating fluid, the driving piston separating said drive enclosure into a first driving chamber and a second driving chamber, a first multiplier chamber and a second multiplier chamber comprising an inlet and an outlet for, respectively, receiving and discharging a delivery fluid, a first multiplier piston, connected to the driving piston and configured to slide within the first multiplier chamber, the sliding of the first multiplier piston ensuring the compression of the delivery fluid inside the first multiplier chamber such that the pressure of the delivery fluid at the outlet is greater than the pressure of the delivery fluid at the inlet of the first multiplier chamber, a second multiplier piston, connected to the drive piston and configured to slide within the second multiplier chamber, the sliding of the second multiplier piston ensuring the compression of the delivery fluid inside the second multiplier chamber such that the pressure of the delivery fluid at the outlet is greater than pressure at the inlet of the second multiplier chamber, an alternating fluid distribution device for alternating the direction of circulation of the operating fluid in the drive enclosure, the pumping system comprising a first fluid inlet opening into the first drive chamber and a first fluid outlet from the second drive chamber for, respectively, receiving and discharging the operating fluid during a first distribution cycle, and that it comprises a second fluid inlet opening into the second drive chamber and a second fluid outlet from the first drive chamber, for, respectively, receiving and discharging the operating fluid during a second distribution cycle, and in that the alternating distribution device comprises at least one shutting-off device comprising four movable shutting-off members of the first and second inlets and first and second outlets of the pumping system and at least one trigger configured to actuate said shutting-off members between two respectively shutting-off and open positions, said alternating distribution device can be actuated between:

a first arrangement associated with the first distribution cycle in which the drive piston moves to its second end position, two of the movable members respectively shut off the second inlet and the second fluid outlet, and the other two movable members respectively open the first inlet and the first fluid outlet to ensure the insertion and discharge of the operating fluid, and a second arrangement associated with the second distribution cycle in which the drive piston moves to its first end position, two of the movable members respectively shut off the first inlet and the first outlet, and the other two movable members respectively open the second inlet and the second outlet to ensure the insertion and discharge of the operating fluid, wherein each activation member comprises a movable piston in a compression chamber provided with two air inlets connected respectively to the first and second trigger, and wherein each trigger comprises a piston which is mechanically connected to the respective rod and movable in a compression chamber between a rest position and an actuation position of the piston of the respective activation member, said compression chamber of the trigger comprising two outlets connected respectively to the first and second activation members.

* * * * *